US005267494A

United States Patent [19]

Waluda

[11] Patent Number: 5,267,494

[45] Date of Patent: Dec. 7, 1993

[54] BOTTLE OPENER

[75] Inventor: Casey E. Waluda, Chicago, Ill.

[73] Assignee: CEW Manufacturing Co., Chicago, Ill.

[21] Appl. No.: 9,885

[22] Filed: Jan. 27, 1993

[51] Int. Cl.[5] ..... B67B 7/44

[52] U.S. Cl. ..... 81/3.09; 81/3.57; D8/34; D8/40

[58] Field of Search ..... 81/3.07, 3.09, 3.4, 81/3.55, 3.57; D8/18, 33, 34, 38, 40; 7/151

[56] References Cited

U.S. PATENT DOCUMENTS

| | | | |
|---|---|---|---|
| D. 89,924 | 5/1933 | Schnoor | D8/18 |
| D. 270,807 | 10/1983 | Dilliner | D8/18 |
| 1,314,905 | 9/1919 | Sard . | |
| 1,338,542 | 4/1920 | Westberg . | |

FOREIGN PATENT DOCUMENTS

| | | |
|---|---|---|
| 24245 | 1/1931 | Australia . |
| 29736 | 12/1920 | Norway . |

*Primary Examiner*—Roscoe V. Parker

*Attorney, Agent, or Firm*—Willian Brinks Olds Hofer Gilson & Lione

[57] ABSTRACT

The present disclosure provides an improved bottle opener incorporated on a key having a head and a body. The head has a U-shaped cutout at a downward angle in the range of about 30° to about 60° with fulcrum and lifting edges. The cutout has a width of about −5% to about +8% that of the thickness of a bottle cap. The fulcrum edge has a radius at the cutout opening that engages the top of a bottle cap without puncturing it. The lifting edge passes beneath the rim of the bottle cap, and the body is long enough to provide leverage sufficient to remove the bottle cap.

15 Claims, 2 Drawing Sheets

BOTTLE OPENER

BACKGROUND OF THE INVENTION

The present invention pertains generally to devices that opens bottle caps, and assist in opening tabs on beverage cans. More specifically, the present invention relates to bottle openers that are incorporated on keys.

For a bottle opener to be available when needed, a person must carry the device on a regular basis. Keys, such as automobile or building keys, are items that most people carry with them on a regular basis. Therefore, it would be advantageous to have a bottle opener that is connected to a key which is carried on a regular basis. Several approaches have been tried by the prior art to produce a key-bottle opener device. None have been entirely satisfactory.

One approach is disclosed in U.S. Pat. No. 1,314,905 to Sard. Sard discloses a bottle opener key with a head that has "an oval ring D" opening (Col. 1, line 24). The opening is shaped to permit placing one side of the oval ring D underneath the bottle cap and formed so as to engage and remove the bottle cap when pressure is exerted on the flat surface of the key's body. Sard also discloses a hook that is mounted on the exterior of the key's head. The problem with the approach disclosed in the Sard patent is that the ring-like opener in the flat surface of the head of the key cannot be easily incorporated into most currently used keys. Although keys come in a variety of shapes, most keys have a solid head with a small internal opening that allows attachment of a key chain or related device. Most keys would require substantial modification to form an opening large enough to engage a bottle cap. Furthermore, in many key shapes, the integrity of the key head may be compromised by the formation of a large internal opening. Hence, this approach is an impractical solution for incorporating an opener into the variety of keys that are currently used in the United States.

A similar approach to incorporating a bottle opener in a key is disclosed in U.S. Pat. No. 1,338,542 to Westerberg and in Norwegian Patent No. 29,736. Westerberg and the Norwegian patent disclose a bottle opener on a key. The key head possesses a substantially elliptical centrally located opening having a rib that engages and removes the bottle cap. This choice suffers from the same problems as the approach disclosed in the Sard patent. Namely, this opener cannot be easily incorporated into a variety of key shapes in existence.

Another approach to providing an opener with a key is disclosed in Australian Patent No. 24,245. This patent discloses a separate bottle cap remover for attachment to the exterior of a key head. A key ring manipulates a metal socket that is secured over the key head to engage and remove the bottle cap. The problem with this is that it strays from the relatively uncomplicated structure of the other openers by adding moving parts to the exterior of the key head. The addition of these parts increases the likelihood of breakdown and requires that metal sockets be on hand for each different key shape.

Thus, the prior attempts were unsuccessful in providing an efficient and economical solution for incorporating a bottle opener into the variety of key shapes in existence. There is, therefore, an unsatisfied long felt need for a bottle opener that can be easily and inexpensively incorporated into the majority of keys that are presently in use, including presently used car keys.

SUMMARY OF THE INVENTION

The present invention provides an improved bottle opener incorporated on a key having a head and a body. The head has a U-shaped cutout at a downward angle in the range of about 30° to about 60° with fulcrum and lifting edges. The cutout has a width of about −5% to about +8% that of the thickness of a bottle cap. The fulcrum edge has a radius at the cutout opening that engages the top of the bottle cap without puncturing it. The lifting edge passes beneath the rim of the bottle cap, and the body is long enough to provide leverage sufficient to remove the bottle cap.

Additional aspects of the invention involve providing an insert or sleeve that fits into or over the cutout. An insert made of plastic, brass, or steel fits snugly into the cutout. Also, a sleeve made of a material, such as rubber or plastic, can be placed over the cutout. The addition of the insert or the sleeve prevents the lower edge of the cutout, which may be sharp, from coming in contact with other objects such as the interior of a pocket or purse.

The present invention has a number of advantages over other bottle openers incorporated on a key. This invention can be used with virtually any shape of functional key or key blank. "Functional key" is a key that has already been machined to operate a specific lock whereas, "key blank" means that the key requires additional machining before it can operate a specific lock. Also, this invention permits minimal alteration of existing keys to create a bottle opener. Additionally, this invention can transform keys into bottle openers within a short period of time; thereby, minimizing the inconvenience to the key's owner. Furthermore, this invention does not add moving parts and, thus reduces the opportunity for a breakdown.

It is an object of the present invention to incorporate an improved bottle opener into the majority of key shapes comprising functional keys and key blanks.

It is another object of this invention to provide an efficient process for converting functional keys and key blanks into improved bottle openers.

It is another object of this invention to provide a method of using an improved bottle opener.

The present invention, together with attendant objects and advantages, will be best understood with reference to the detailed description below, read in conjunction with the accompanying drawings.

DETAILED DESCRIPTION OF THE PRESENTLY PREFERRED EMBODIMENTS

Surprisingly, it has been discovered that a U-shaped cutout provided in the head of a functional, conventional key or key blank, such as a conventional car key, allows opening of bottles without breaking the key. Furthermore, the repeated opening of bottles do not substantially weaken the key.

Figure 5:
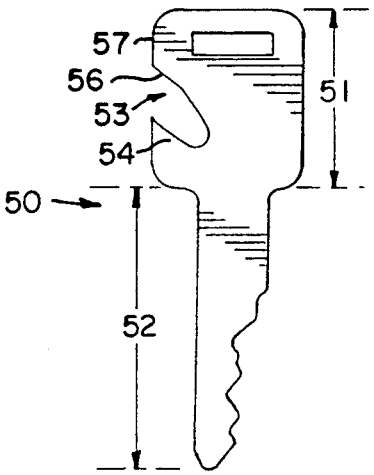
FIG. 5 is an elevational view of the fourth preferred embodiment of the improved bottle opener of the present invention.

Surprisingly, the head and body of most keys can easily accommodate an improved bottle opener. The head of a key made from a conventional material, such as aluminum or brass, is strong enough to open bottles when provided with a U-shaped cutout described in the present invention. The "head" is the end portion of a key that a person grasps and turns when opening a lock. Furthermore, a typical key body, about 1⅛ inch to about 1¾ inches in length, provides sufficient leverage for the U-shaped cutout to engage and remove a bottle cap. The "body" is the elongated stem of the key that includes the region that fits into a lock. FIG. 5 in the drawings illustrates the head 51 and body 52 portions of a key.

It has been discovered that forming a U-shaped cutout at a downward angle of about 30° to about 60° within the key's head enables a key to engage bottle caps. A "U-shaped cutout" is a cutout that resembles a "U" because of substantially parallel edges separated by a base. For example, FIGS. 1, 4, 5, and 6, as depicted in the drawings, show a variation of cutouts that are U-shaped in appearance. The U-shaped cutout is at a downward angle. A "downward angle" is measured from a longitudinal axis running through the midsection of a key s head and body when the key is perpendicular to a surface. In this perpendicular orientation, the head is in the up position, farthest from the surface, and the body is in the down position, nearest to the surface. For example, FIG. 2 in the drawings, illustrates the measurement of a downward angle 3.

Figure 1:
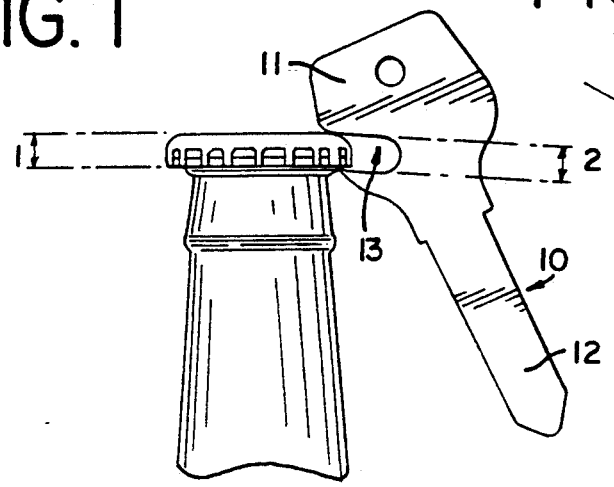
FIG. 1 is an elevational view showing a first preferred embodiment of the improved bottle opener of the present invention positioned to remove a bottle cap.

It has been discovered that the following widths and depths permit the U-shaped cutout to effectively engage bottle caps. The acceptable width of the cutout ranges from about −5% to about +8% that of the thickness of the bottle cap. The width of a cutout is measured at the opening of the cutout from the fulcrum edge to the lifting edge. FIG. 1 of the drawings shows a width 2 measurement of a cutout. Thickness of a bottle cap is measured from the top of the cap to the bottom side wall edge when the container is in an upright position. FIG. 1 of the drawings shows a thickness measurement 1 of a bottle cap. The smallest depth of the cutout that allows the edges of the cutout to engage and remove the cap is preferable to retain the head's strength.

When an upward force is applied to the body of the key, the edges of the cutout engage and remove the bottle cap. The lifting edge is the edge that passes beneath the rim of a bottle cap, and lifts the bottle cap away from the bottle. The rim of the bottle cap is the surface of the bottle cap next to the bottle that is pried to open the bottle. The fulcrum edge is the edge that makes contact with the top of the bottle cap and acts as a fulcrum. The fulcrum edge has a radius at the cutout opening that engages the top of a bottle cap without puncturing it. The fulcrum edge is rounded because sharp edges may puncture the bottle cap, and thereby provide a less desirable way of opening a bottle.

It has been found that a bottle opener made within the following ranges enables a key to remove a standard bottle cap and assist in opening tabs on beverage cans. The U-shaped cutout should be at a downward angle in the range of about 30° to about 60°. The width of the cutout should be about 0.270 inch to about 0.315 inch. The cutout depth ranges from about 3/32 inch to about ½ inch depending on the shape of the key. The fulcrum edge has a radius at the cutout opening that engages the top of the bottle cap without puncturing it. A radius at the fulcrum edge of at least 1/32 inch is preferable. Lastly, the lifting edge of the cutout passes beneath the rim of the bottle cap, and the body has sufficient length to be used as a lever to remove the bottle cap.

Figure 2:
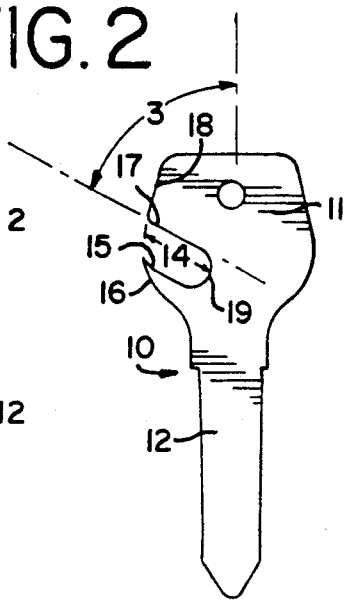
FIG. 2 is an elevational view of the first preferred embodiment shown in FIG. 1.

Referring to the drawings, FIGS. 1-2 show a first preferred embodiment of the present invention.

FIG. 1 shows an improved bottle opener 10 with a key head 11 and a key body 12 positioned to open a bottle cap. The width 2 of the cutout 13 measures about 0.295 inches. The thickness 1 of the bottle cap is measured from its top to the edge of its sidewall.

FIG. 2 shows an improved bottle opener 10 with a key head 11 and key body 12. In FIG. 2, the head 11 has a U-shaped cutout 13 at a downward angle 3 in the range of about 30° to about 60°. The depth 14 of the cutout 13 measures about 3/32 to about ½ inch. The fulcrum edge 17 of the cutout 13 meet an external edge 18 to form a radius of about 1/16 inches. The lifting edge 15 of the cutout 13 meets an external key edge 16 to form a fifteen degree angle that passes beneath the rim of a bottle cap. The radius at the base 19 of the cutout 13 is about 0.125 inches. The key body 12 acts as a lever to remove the bottle cap.

Figure 3:
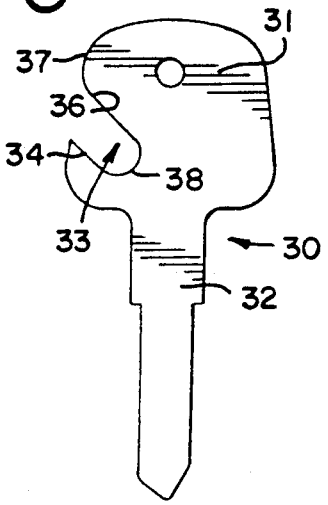
FIG. 3 is an elevational view of the second preferred embodiment of the improved bottle opener of the present invention.

FIG. 3 shows an improved bottle opener 30 with a key head 31 and a key body 32. In FIG. 3, the head 31 has a U-shaped cutout 33 at a downward angle of about 30° to about 60°. The width of the cutout 33 measures about 0.312 inches. The fulcrum edge 36 of the cutout meets an external edge 37 to form a radius of about 1/16 inches. The lifting edge 34 of the cutout 33 passes beneath the rim of a bottle cap. The radius at the base 38 of the cutout is a full radius. The key body 32 acts as a lever to remove the bottle cap.

Figure 4:
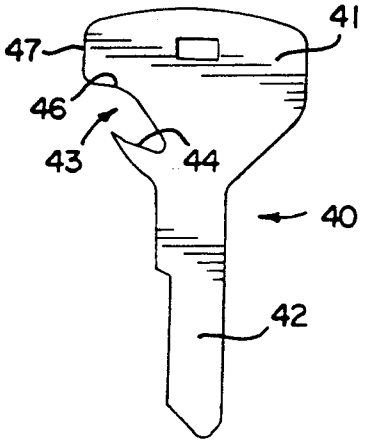
FIG. 4 is an elevational view of the third preferred embodiment of the improved bottle opener of the present invention.

FIG. 4 shows an improved bottle opener 40 with a key head 41 and a key body 42. In FIG. 4, the head 41 has a U-shaped cutout 43 at a downward angle in the range of about 30° to about 60°. The width of the cutout 43 measures about 0.312 inches. The fulcrum edge 46 meets an external edge 47 to form a radius of about 1/16 inches. The lifting edge 44 of the cutout 43 passes beneath the rim of a bottle cap. The key body 42 acts as a lever to remove the bottle cap.

FIG. 5 shows an improved bottle opener 50 wherein the key is a General Motors ignition key having a head 51 and a body 52. In FIG. 5, the head 51 has a U-shaped cutout 53 at a downward angle of about 30°. The width of the cutout 53 measures about 0.312 inches. The fulcrum edge 56 of the cutout 53 is rounded to meet an external edge 57 and form a radius. The lifting edge 54 of the cutout 53 forms a sharp point that passes beneath the rim of a bottle cap. The body 52 acts as a lever to remove the bottle cap.

Figure 6:
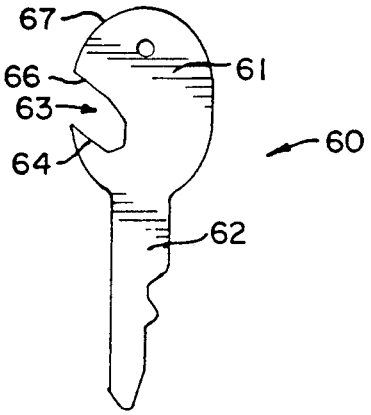
FIG. 6 is an elevational view of the fifth preferred embodiment of the improved bottle opener of the present invention.

FIG. 6 shows an improved bottle opener 60 wherein the key is a General Motors trunk key having a head 61 and a body 62. In FIG. 6, the head 61 has a U-shaped cutout 63 at a downward angle of about 30°. The width of the cutout 63 measures about 0.312 inches. The fulcrum edge 66 of the cutout 63 is rounded to meet an external edge 67 and form a radius. The lifting edge 64 of the cutout 63 passes beneath the rim of a bottle cap. The key body 62 acts as a lever to remove the bottle cap.

Figure 7:
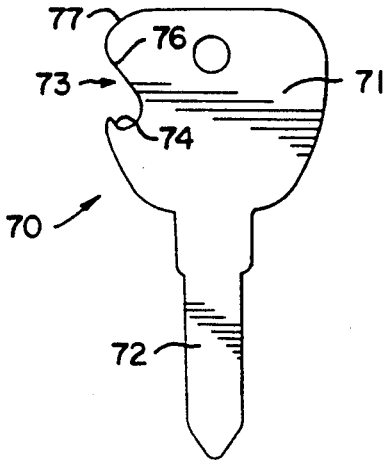
FIG. 7 is an elevational view of the sixth preferred embodiment of the improved bottle opener of the present invention.

FIG. 7 shows an improved bottle opener 70 wherein the key is a BMW automobile key having a head 71 and a body 72. In FIG. 7, the head 71 has a U-shaped cutout 73 at a downward angle of about 40°. The width of the cutout 73 measures in the range of about 0.270 to about 0.315 inches. The fulcrum edge 76 of the cutout 73 meets an external edge 77 to form a full radius. The lifting edge 74 of the cutout 73 passes beneath the rim of a bottle cap. The body 72 acts as a lever to remove the bottle cap.

Figure 8:
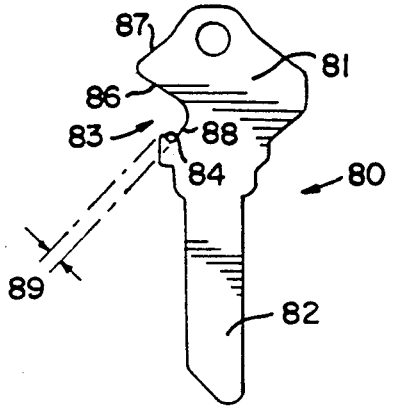
FIG. 8 is an elevational view of the seventh preferred embodiment of the improved bottle opener of the present invention.

FIG. 8 shows an improved bottle opener 80 having a key head 81 and a key body 82. In FIG. 8, the head 81 has a U-shaped cutout 83 at a downward angle of about 60°. The width of the cutout 83 measures in the range of about 0.280 to about 0.315 inches. The lifting edge 84 of the cutout 83 from its point to the base 88 of the cutout measures in the range 89 of about 0.080 inch to about 0.095 inch. The fulcrum edge 86 of the cutout 83 is rounded to meet an external edge 87 and form a radius. The lifting edge 84 of the cutout 83 passes beneath the rim of a bottle cap. The body 82 acts as a lever to remove the bottle cap.

Figure 9:
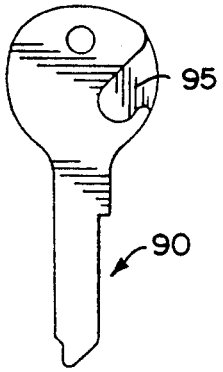
FIG. 9 is an elevational view of the eighth preferred embodiment of the improved bottle opener of the present invention with an insert in the cutout.
Figure 10:
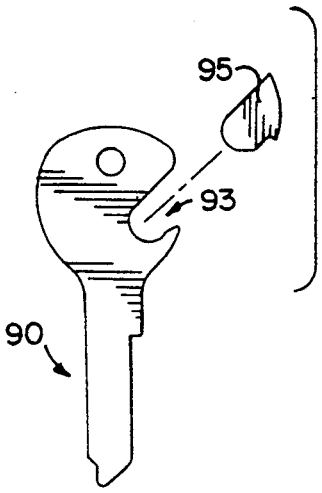
FIG. 10 is an elevational view of the eighth preferred embodiment of the improved bottle opener of the present invention with the insert removed from the cutout.

FIGS. 9–10 show an embodiment of the present invention used in conjunction with an insert 95. FIG. 9 shows an improved bottle opener 90 with an insert 95 in the cutout 93. Preferably, the insert is made of a flexible material such as plastic or brass. FIG. 10 shows the same bottle opener with the insert 95 removed from the cutout 93 so that the opener can engage a bottle cap.

Figure 11:
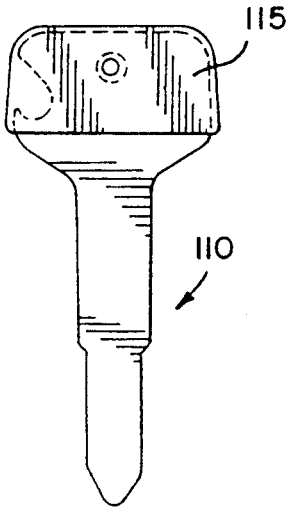
FIG. 11 is an elevational view of the ninth preferred embodiment of the improved bottle opener of the present invention with a sleeve covering the cutout.
Figure 12:
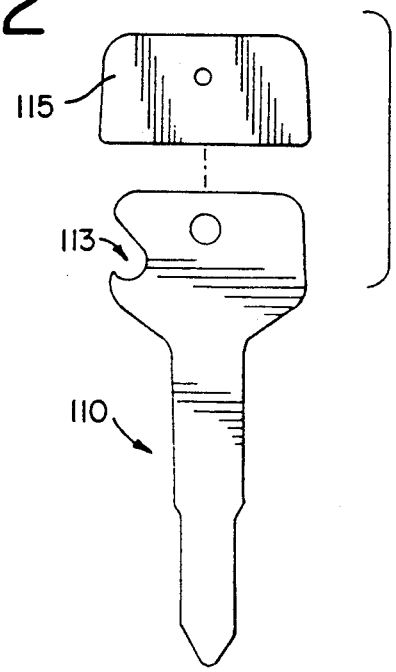
FIG. 12 is an elevational view of the ninth preferred embodiment of the improved bottle opener of the present invention with the sleeve removed from the key.

FIGS. 11–12 show an embodiment of the present invention used in conjunction with a sleeve 115. FIG. 11 shows an improved bottle opener 110 made from a Toyota automobile key and used in conjunction with a sleeve 115 that covers the cutout 113. FIG. 12 shows the same bottle opener with the sleeve 115 no longer covering the cutout 113 so that the opener can engage a bottle cap. However, if a sleeve is made of a flexible material, such as rubber, then the sleeve does not have to be completely removed to engage a bottle cap. A person can merely pull back the rubber sleeve to expose the cutout without removing the sleeve.

The operation of the improved bottle cap opener is the same in all the different embodiments of the invention. As illustrated using FIGS. 1 and 2, the lifting edge 15 of the cutout 13 passes beneath the rim of a bottle cap, while the fulcrum edge 16 of the cutout 13 fits against the top of the bottle cap. An upward force is applied to the key body 12 whereby the fulcrum edge 16 acts as a fulcrum and permits the lifting edge 15 to pry the bottle cap away from the bottle.

It should be appreciated that an improved bottle opener incorporated on a key encompasses various key shapes. The embodiments described above are to be considered in all respects only as illustrative and not restrictive. The use of specific automobile keys, such as Toyota, BMW, and General Motors, is intended merely for illustration and not as a limitation. The scope of the invention is indicated by the following claims rather than by the foregoing description. All changes that come within the meaning and equivalency of the claims are to be embraced within their scope.

I claim:

1. An improved bottle opener comprising:

a key having a head and a body, said head having a U-shaped cutout at a downward angle in the range of about 30° to about 60° with fulcrum and lifting edges, said cutout having a width of about −5% to about +8% that of the thickness of a bottle cap, said fulcrum edge has a radius at the cutout opening that engages the top of the bottle cap without puncturing it, said lifting edge passes beneath the rim of the bottle cap, and said body being long enough to provide leverage sufficient to remove the bottle cap.

2. The device in claim 1 wherein the radius of the fulcrum edge is at least 1/32 inch.

3. The device in claim 1 further comprising an insert that fits snugly into the cutout.

4. The device in claim 1 further comprising a sleeve that fits over the cutout.

5. The device in claim 1 wherein the key is a functional key.

6. The device in claim 1 wherein the key is a key blank.

7. An improved bottle opener comprising:

a key having a head and a body, said head having a U-shaped cutout at a downward angle in the range of about 30° to about 60° with fulcrum and lifting edges, said cutout having a width of about 0.270 inch to about 0.315 inch and a depth of about 3/32 inch to about ½ inch, said fulcrum edge has a radius at the cutout opening that engages the top of a bottle cap without puncturing it, said lifting edge passes beneath the rim of the bottle cap, and said body being long enough to provide sufficient leverage to remove the bottle cap.

8. The device in claim 7 wherein the radius of the fulcrum edge is at least 1/32 inch.

9. The device in claim 7 further comprising an insert that fits snugly into the cutout.

10. The device in claim 7 further comprising a sleeve that fits over the cutout.

11. The device in claim 7 wherein the key is a functional key.

12. The device in claim 7 wherein the key is a key blank.

13. A process for incorporating an improved bottle opener on a key comprising the steps of:

providing a key having a head and a body; cutting a section of the head of the key to form a U-shaped cutout at a downward angle in the range of about 30° to about 60°, the width of said cutout being about −5% to about +8% that of the thickness of a bottle cap; removing said section from the key's head; and adapting the fulcrum and lifting edges of the cutout to engage the bottle cap.

14. The process in claim 13 wherein the key is a functional key.

15. The process in claim 13 wherein the key is a key blank.

* * * * *